US007195136B2

(12) United States Patent
von Schuckmann

(10) Patent No.: US 7,195,136 B2
(45) Date of Patent: Mar. 27, 2007

(54) DISPENSER FOR SUPPLYING PORTIONS OF PASTY MASSES

(76) Inventor: Alfred von Schuckmann, Winnekendonker Str. 52, Kevelaer (DE) D-47627

( * ) Notice: Subject to any disclaimer, the term of this patent is extended or adjusted under 35 U.S.C. 154(b) by 0 days.

(21) Appl. No.: 10/514,142

(22) PCT Filed: May 15, 2003

(86) PCT No.: PCT/EP03/05110

§ 371 (c)(1),
(2), (4) Date: Oct. 14, 2005

(87) PCT Pub. No.: WO03/097482

PCT Pub. Date: Nov. 27, 2003

(65) Prior Publication Data

US 2006/0097014 A1 May 11, 2006

(30) Foreign Application Priority Data

May 21, 2002 (DE) ..... 102 22 375

(51) Int. Cl.
*B67D 5/42* (2006.01)

(52) U.S. Cl. ..... 222/209; 222/260; 222/387

(58) Field of Classification Search ..... 222/209, 222/260, 387

See application file for complete search history.

(56) References Cited

U.S. PATENT DOCUMENTS 4,776,496 A * 10/1988 Battegazzore ..... 222/209
4,821,926 A * 4/1989 Battegazzore ..... 222/209
4,978,037 A * 12/1990 Schuckmann ..... 222/260
4,991,744 A * 2/1991 Von Schuckmann ..... 222/207

* cited by examiner

*Primary Examiner*—Philippe Derakshani
(74) *Attorney, Agent, or Firm*—Martin A. Farber

(57) ABSTRACT

Dispenser for delivering portions of pasty substances has an emptying nozzle (18) associated with a squeeze head (13), and a tubular housing (1) in which a plunger (9) is displaced in a stepwise manner during a process of emptying the dispenser. Displacement of the plunger occurs in the direction toward the nozzle (18). The squeeze head can be pressed in, in the direction of the plunger (9), and can be actuated via a handle (H). A cover (21) closes an opening (20) of the nozzle (18). A pivot-pin connection (DV) is provided between the cover and the nozzle, and a slit/pivot pin mounting (23/22) is disposed between cover and the housing such that, once the cover has been displaced open partially, the pivot pin (22) is displaced in the pressing-in direction of the squeeze head (13), and the nozzle is carried along in the process, by way of support against a housing-side abutment (w).

7 Claims, 4 Drawing Sheets

Sp
H
DV
W
I
II
2
3
5
6
13
13'''
14
19
20
22
23
23'
23''
24
27
28
29
30
31
32
33
35
36
37
38
a
b
y
z
β
γ

DISPENSER FOR SUPPLYING PORTIONS OF PASTY MASSES

This application is a 371 of PCT/EP03/05110 filed May 15, 2003.

FIELD AND BACKGROUND OF THE INVENTION

The invention relates to a dispenser for delivering portions of pasty substances, having a tubular housing in which a plunger is displaced in a stepwise manner, during emptying actuation, in the direction of an emptying nozzle, which is associated with a squeeze head, which can be pressed in in the direction of the plunger and can be actuated via a handle, and is associated with a cover, which closes the opening cross-section of the emptying nozzle.

EP-A1 0 214 106 discloses a squeeze head with this associated emptying nozzle. The cover, which keeps the opening cross-section closed, is part of a handle which is mounted about a stationary pivot pin. Via this handle, a neck of the squeeze head is displaced for pump-like action relative to a plunger-like plug-in end of the emptying nozzle. When the handle is released, the cover, utilizing the restoring force of the squeeze head, moves back into its closed position.

DE-A1 37 16 822 discloses a dispenser of the generic type in which the squeeze head is actuated via a separate, pivotably mounted handle. The actuating force is introduced into the squeeze head via bending portions. The bending portions are of such a length that they compensate for different movement sequences between the handle and the squeeze head. Upon actuation, the opening cross-section of the emptying nozzle lifts up, for all practical purposes, axially from the cover, which is stationary here.

SUMMARY OF THE INVENTION

It is an object of the invention to form a dispenser of the generic type in a structurally straightforward and easy-to-handle manner.

This object is achieved first and foremost in the case of a dispenser having the features of Claim 1, to be precise by a pivot-pin connection between cover and emptying nozzle.

Such a configuration achieves a structurally and functionally advantageous solution: the pivot-pin connection does not just cover the rotary/pivoting action for the handle, but also functions as a connecting element between two main parts of the dispenser mechanism. This results, for all practical purposes, in direct actuation and, in addition, in structural simplification. The subject matters of the rest of the claims are explained hereinbelow in relation to the subject matter of Claim 1, but may also be important in their independent formulation. The cover and handle thus form a unit. The rest of the construction is characterized by a slit/pivot-pin mounting between the cover and housing such that, once the cover has been pivoted open partially, the pivot pin is displaced in the pressing-in direction of the squeeze head, the emptying nozzle being carried along in the process, by way of support against a housing-mounted abutment. Such a slit may also be provided for directly in the housing. It is dimensioned such that it is only once the cover has been opened partially that the emptying nozzle is carried along and the pump is thus actuated. This guarantees a clean delivery. This is also evident on the exterior as the dispenser is used to an increasing extent; there is no need for the dispenser head to be constantly cleaned. Conversely, as the restoring movement of the squeeze head begins, any excess pasty substance is removed by suction from the emptying-nozzle mouth or the opening cross-section of the same, that is to say is sucked in. Straightforward handling is made possible by the fact that the cover terminates in a spiked-helmet-like protrusion. Such an exposed protrusion forms an advantageous lever and can be reliably reached and felt. Self-stiffening of the cover as a whole is also achieved, so that it is also possible to work with fairly thin walls. As far as the mechanics are concerned, it proves to be advantageous if the abutment is formed by a wing which projects in the direction of the pivot pin and against the underside of which the flank of an arm of the cover strikes. The said arm is restrained against the underside in the region of the pivot-pin connection, the squeeze head being compressed in the process. Furthermore, it is provided that the lower periphery of the cover penetrates into a matching recessed channel of the housing. This all preferably takes place such that it is possible to dispense with a conventional protective cap or over-cap, in that the cover, in the rest of its configuration, is integrated in the shape of the dispenser head, this being done in the manner of a smooth, virtually flush transition from the movable part into the fixed part. Finally, it proves to be advantageous from a point of view of actuation if the pivoting path of the cover to the point where the opening cross-section of the emptying nozzle is exposed is greater than the rest of the pivoting path of the cover for the pressing-in movement of the squeeze head. This makes it possible largely to expose the opening cross-section in the first instance such that correctly targeted, clearly visibly effectible application is reliably achieved.

The subject matter of the invention is explained in more detail hereinbelow with reference to an exemplary embodiment illustrated in the drawings, in which:

DETAILED DESCRIPTION OF THE PREFERRED EMBODIMENT(S)

Figure 2:
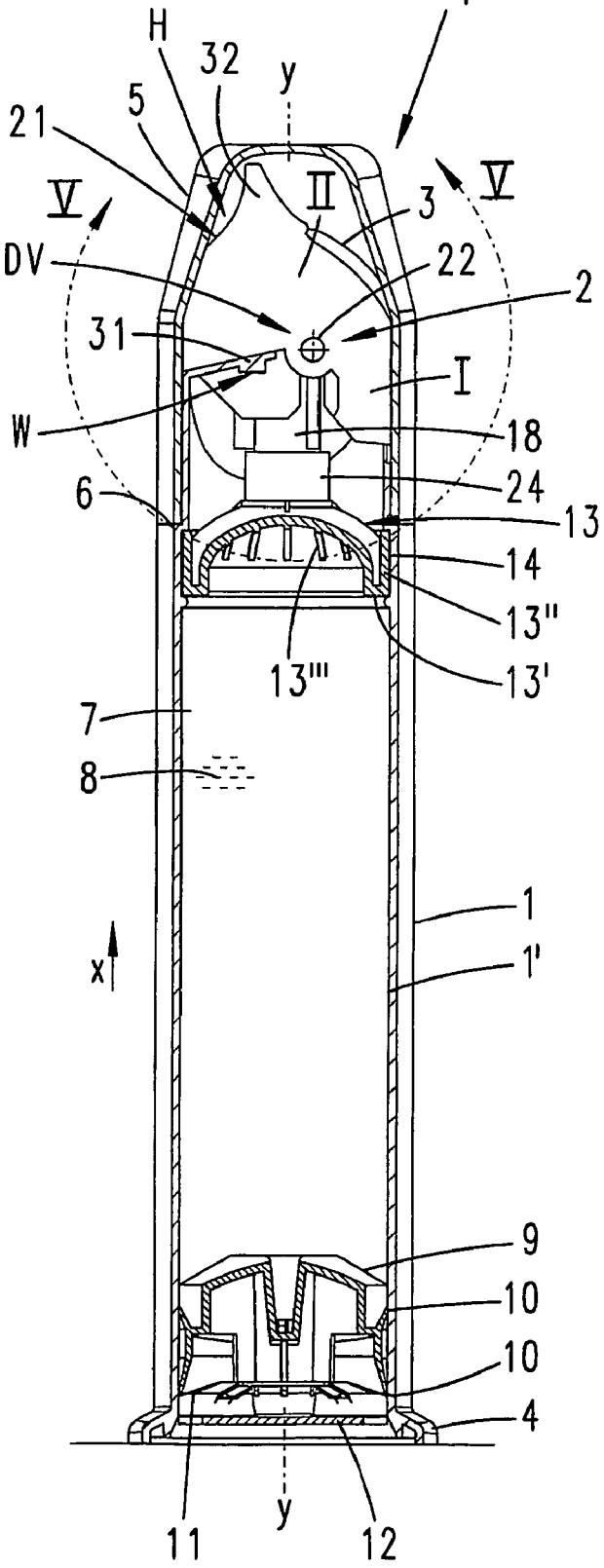
FIG. 2 shows the section along line II—II in FIG. 1.
Figure 1:
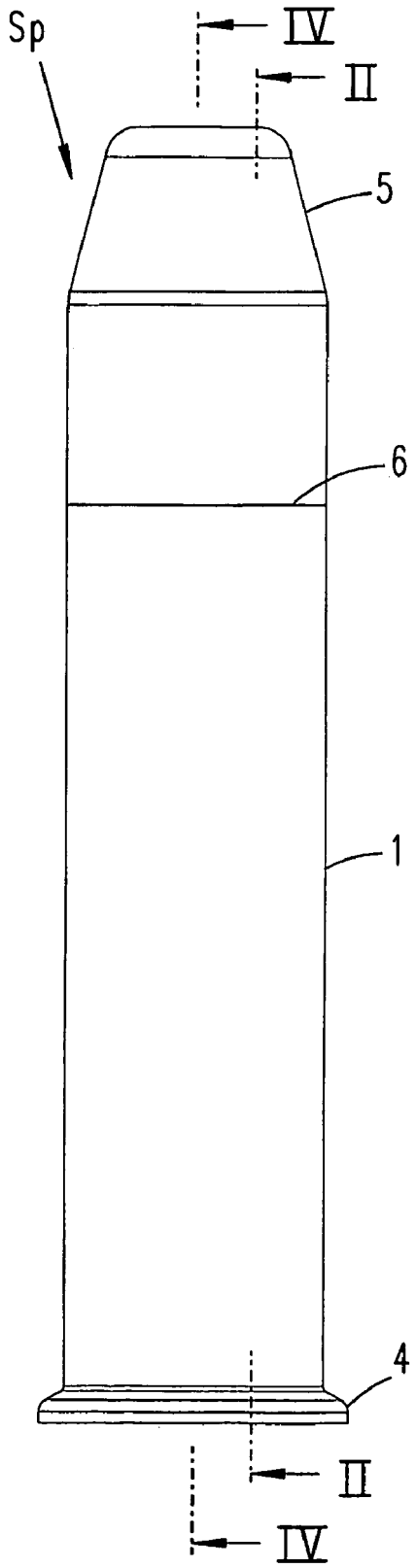
FIG. 1 shows, in side view, the dispenser realized as a stand-up unit, closed by a protective cap.
Figure 3:
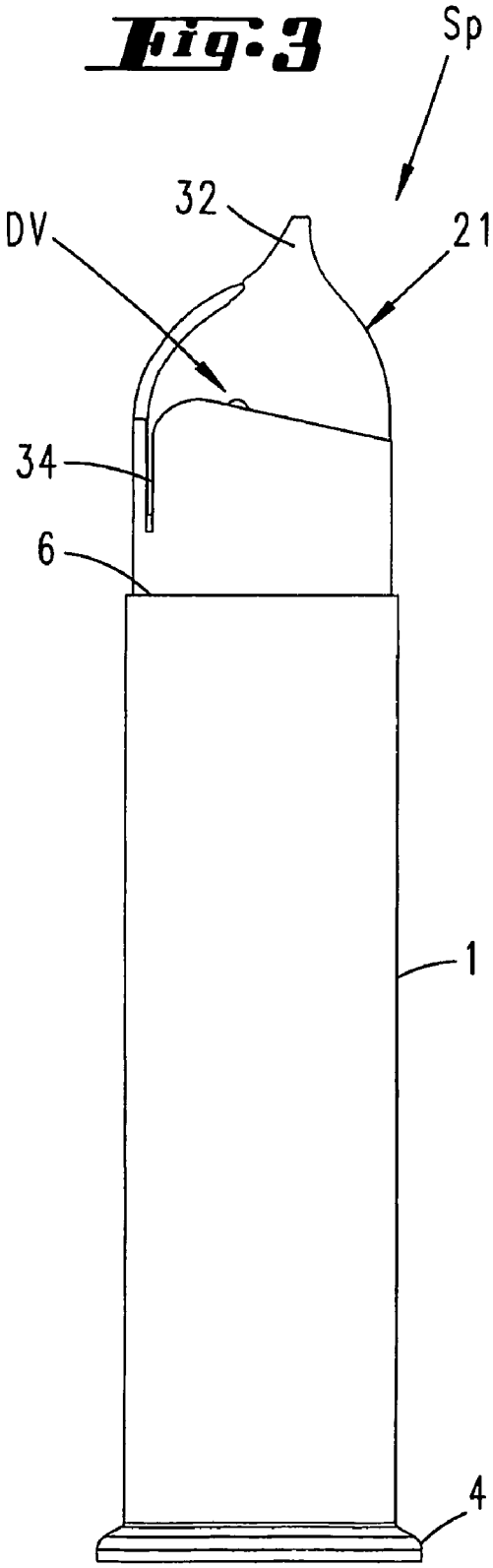
FIG. 3 shows a side view of the dispenser turned through 180° and with the protective cap removed.

The dispenser Sp illustrated is realized as a stand-up unit. It has a tubular housing 1. The latter has, at the top, a dispenser head 3 containing the dispenser mechanism 2. At the bottom, the housing 1 continues into a widened standing pedestal 4.

The dispenser head 3, which is integral with the housing 1, can be covered by a protective cap 5 when the dispenser is not in use. It can be plugged on with a friction fit and is stop-limited against an annular shoulder 6, which is achieved by an offset in the wall of the cylindrical housing 1.

Most of the length of the housing 1 serves, in terms of volume, as a storage space 7. It accommodates pasty substance 8. This may be a main substance, for example toothpaste.

The pasty substance 8 can then have a further pasty substance applied over it. This further pasty substance is located predominantly in the base region of the dispenser head 3 and forms an additional substance, for example in the form of a mouthwash component. The latter is applied, in known manner, in strip form to an elongate portion of substance which is formed for apportioned delivery. The dispenser mechanism 2, in this respect, has a pump-like discharging action. A device which forms the strip structure is not illustrated in the drawing. However, it can be gathered, for example, from DE-A1 37 16 822, which was mentioned in the introduction.

The lower termination of the storage space 7 is formed by a plunger 9. This is realized as a follow-up plunger. It is inserted into the housing 1 from beneath and, in the process, simultaneously performs a cover function.

The plunger 9 is displaceable in a stepwise manner only in the emptying direction arrow x corresponding to emptying actuation. In this case, peripheral lips 10 of the plunger 9 are guided along the cylindrical inner wall 1' of the housing 1.

On the side which is directed toward the standing pedestal 4, the plunger 9 carries a so-called clamping module 11. This has usually radially oriented spikes. Such a spike ring made of spring steel, moved into one plane, has a circumscribing diameter which is larger than the clear diameter of the cylindrical storage space 7. Accordingly, the slightly obliquely positioned spike ends dig, like supporting feet, into the inner wall 1' which, in this respect, is correspondingly capable of interlocking. The entire arrangement is covered by an outer plate 12. Further technical details relating to such a clamping catch can be gathered in a variety of embodiments from the prior art. No further explanation will therefore be given here.

The core of the pump for the plunger 9, this pump discharging the pasty elongate portion of substance, is formed by a dome-like squeeze head 13. The squeeze head 13, which is similar to a pump bellows, consists of elastomeric, resilient material and extends in the base region of the dispenser head 3. In specific terms, it is accommodated on the inner wall 1' of the housing 1 in the transition region between storage space 7 and dispenser head 3, secured in an annular groove 14. The upper flank 15 of the annular groove 14 is achieved by the offset in the wall of the housing 1, which forms the annular shoulder 6; the lower flank 16, in contrast, is formed by a transversely convexly running annular rib 17.

The compressible, pumping region of the squeeze head 13 is not incorporated in the securing means described. Rather, a cylindrical sleeve 13" which extends from the lower end periphery 13' of the dome-like squeeze head 13 and is turned over to stand freely in the emptying direction x is secured with axial fixing. It overcomes the action, during plug-in positioning, of the annular rib 17, which otherwise serves for securing purposes, and snaps into the annular groove 14.

Figure 4:
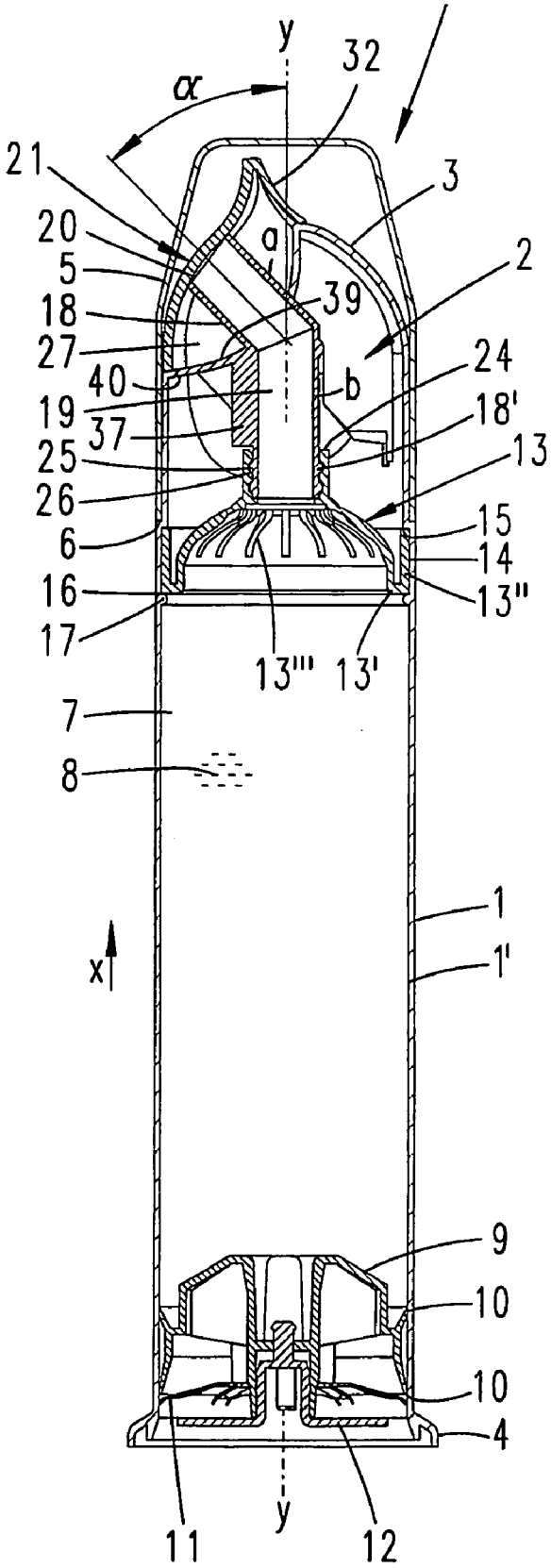
FIG. 4 shows the section along line IV—IV in FIG. 1.

The operation of discharging the elongate portion of pasty substance 8, optionally including the components applied in a strip-like manner, takes place via an emptying nozzle 18 consisting of relatively stiff material. The emptying nozzle 18 is realized as an angled tube and has a extrusion-forming channel 19. Accordingly, the emptying nozzle 18 is made up of an angled portion a, which can be released in a freely projecting manner, and a vertical portion b, which runs coaxially in relation to the longitudinal center axis y—y of the basically rotationally symmetrical dispenser Sp. The enclosed angle of inclination alpha is around 45°, see FIG. 4. The opening cross-section 20 of the emptying nozzle 18, this opening cross-section forming a dispenser mouth, has a cover 21 gripping over it with closing action in the basic position of the dispenser Sp.

The cover 21 is of helmet-like configuration. It has both a closing function, in the manner indicated, and a pump-actuating function. For this purpose, it also forms the handle H. The cover 21 and handle form a unit, this being a single-piece body configured in the form of a spiked helmet.

Functioning takes place via a pivot-pin connection DV between the cover 21 and the emptying nozzle 18. The pivot pin is designated 22. It is provided in a pair and can be snapped in, for bearing purposes, via run-on slopes.

Mounting is carried out in a stationary manner; it takes place in the dispenser head 3. The latter has a slit 23, which is likewise configured in a pair. The slit 23 can be seen in the actuating position of the cover 21 according to FIG. 7 by virtue of this figure being cut away.

The slit 23 is formed as a slot. This runs in the direction of the pressing-in movement of the squeeze head 13, that is to say counter to the direction of the arrow x.

Accordingly, the pivot-pin connection DV or slit/pivot-pin mounting 23/22 between the cover 21 and housing 1 is carried out such that, once the cover 21 has been pivoted open partially (see position according to FIG. 6), the pivot pin 22 is displaced in the pressing-in direction of the squeeze head 13, the emptying nozzle 18 being carried along in the process, by way of support against a housing-side abutment W.

In order to convert this displacement movement into the compressed position of the squeeze head 13, the other, lower end 18' of the emptying nozzle 18, that is to say the portion b, is in a non-displaceable, i.e. fixed, plugging connection with the squeeze head 13, which can be pressed in in the direction of the plunger 9. The correspondingly pluggable end 18' of the portion b of the emptying nozzle 18, this portion running vertically in the basic position, is accommodated in a squeeze-head neck 24 located at the apex of the dome-like squeeze head 13. The correspondingly non-slip interconnection is achieved by annular beads 25 of the portion b interengaging in corresponding annular grooves 26 in the neck interior of the squeeze head 13.

Figures 5, 6, 7:
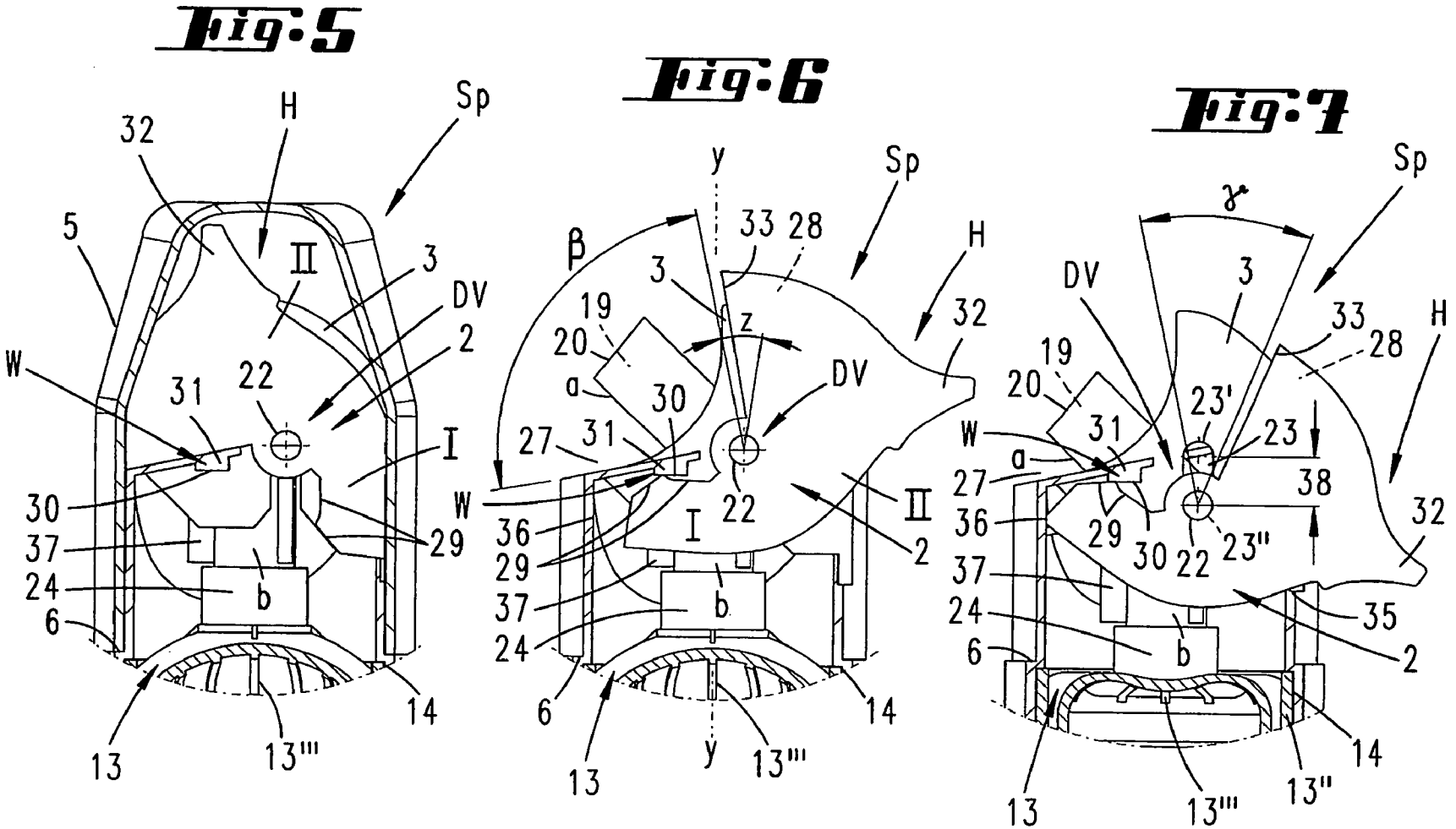
FIG. 5 shows an enlargement V—V from FIG. 2.
FIG. 6 shows the enlargement according to FIG. 5, to be precise as the cover is being pivoted open.
FIG. 7 shows the enlargement according to FIG. 6, in this case with slit-enabled displacement of the cover and thus the squeeze head being actuated for the purpose of delivering portions of pasty substance.
Figure 8:
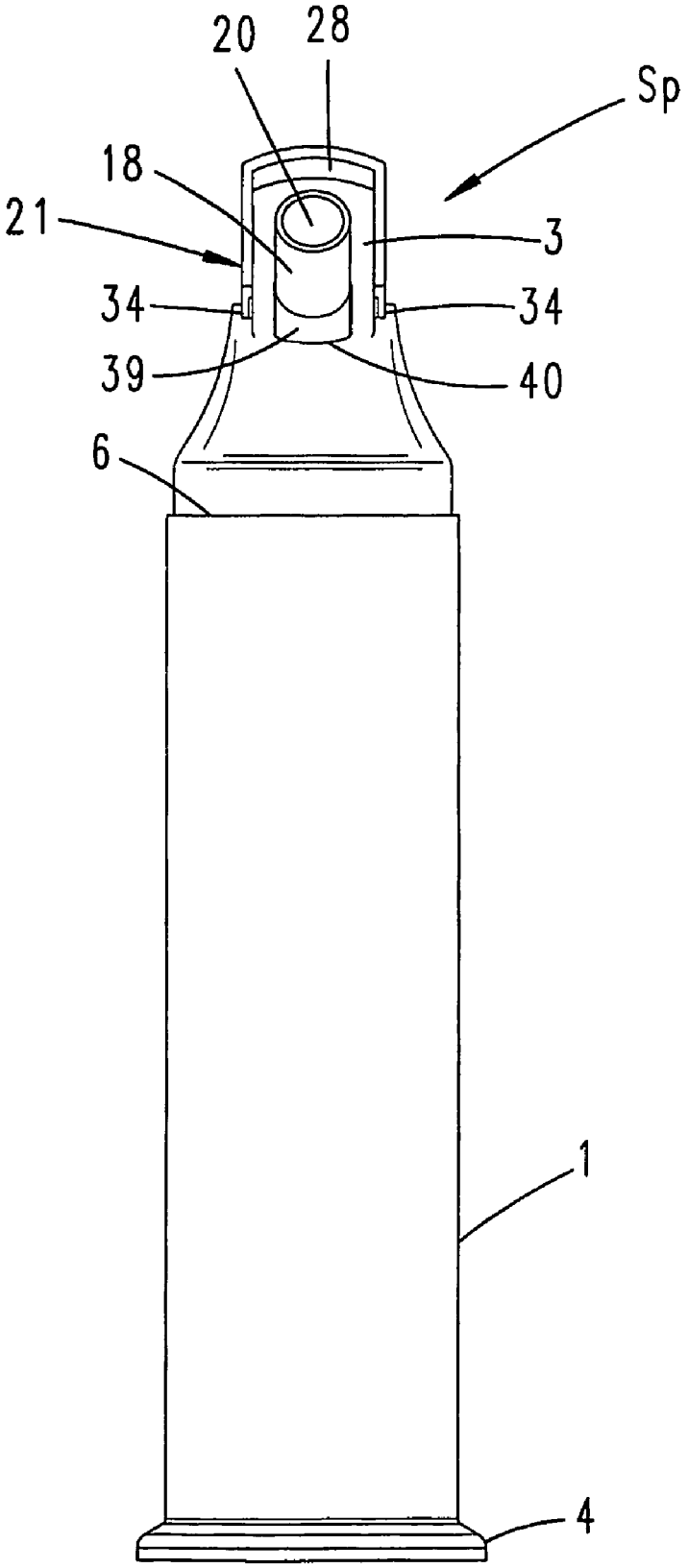
FIG. 8 shows a front elevation view of the dispenser.

For exposing the opening cross-section 20 in first instance in order to discharge the elongate portion of substance in second instance, the cover 21, configured as a helmet, can be opened in the region or surroundings of the dispenser head 3 to form a relatively large jaw 27, see FIG. 6. The structural coordination in respect of the dispenser mechanism here is thus such that the pivoting path of the cover 21 to the point where the opening cross-section 19 of the emptying nozzle is exposed is greater than the rest of the pivoting path of the cover 21 for the pressing-in movement of the squeeze head 13. The first pivoting path, in relation to the pivot pin 22, supported in the upper end 23' of the slit 23, encloses an angle beta of approximately 90°. When the jaw 27 is fully open, the freely projecting portion a of the emptying nozzle 18 extends along the angle bisector of the said angle beta.

In contrast, the pivoting path which follows on, in terms of movement, from this intermediate position of the cover 21, referred to as the rest of the pivoting path, encloses an angle gamma of approximately 40°. Upon reaching this actuating position, the pivot pin 22 is displaced downward to a limited extent in the slit 23 in the housing and runs into the end 23" located there, that is to say the lower end, of the slit 23.

The cover 21 is of double-armed configuration in principle, to be precise in relation to the geometrical rotary-movement/sliding-movement axis of the pivot pin 22.

I is used to designate that arm of the cover 21 which can be moved into the region of action of the abutment W. In the basic position (see FIG. 5), this arm I is in a hanging state, i.e. its free end is oriented toward the squeeze head 13. In this position, a helmet-like portion, if we remain with this helmet metaphor, uses the inside of an eye guard 28 as an actual closing portion to keep the opening cross-section 20 of the emptying nozzle 18 closed (see also FIG. 4).

If the cover 21, which functions simultaneously as a handle H, is then pivoted in the clockwise direction about the pivot pin 22, which is initially supported by a rotary bearing at the upper end 23' of the slit 23, the position according to FIG. 6 is reached. This position is defined with perceptible stop limiting by a flank 29 engaging against the stationary underside 30 of the abutment W.

The abutment W is formed by a wing 31 which extends in the direction of the pivot pin 22 and slopes up slightly in the jaw contour. Its flank 29 is visibly thickened in relation to the rest of the wall region. The actual under-engaging region comprises a raised transverse rounded portion with flanks 29 sloping down in a roof-like manner. The transverse rounded portion avoids planing work between the arm I and the abutment W. The underside 30 is directed toward the longitudinal center of the slit.

In the position according to FIG. 6, the arm I assumes a substantially horizontal position, or perpendicular orientation, in relation to the longitudinal center axis y—y of the dispenser Sp.

The other arm of the cover 21 or of the helmet, this arm being designated II and, for all practical purposes, being located in the region of the neck guard of the helmet, is the actuating arm. This is formed such that it is particularly easy to grip. It terminates in a protrusion 32 which projects centrally beyond the general helmet shape. This extends the lever arm and gives the cover 21 the distinctive spiked-helmet-like configuration. The tip of the protrusion 32 is broken away.

The slit/pivot-pin mounting 23/22 is located in the region of the side guards of the helmet. It is seated, as it were, at the vertex of a right-angled visor opening, realized in the region of the lower periphery 33 of the cover 21.

In the basic position of the cover 21, the lower periphery 33 of the cover 21 enters into a matching passage-like recessed channel 34 of the housing 1. This recessed channel is formed on the dispenser head 3, wall portions of the recessed channel 34 which run in the pivoting plane of the cover 21 being utilized as guide surfaces. The cover-side wall portions are configured such that they can be guided correspondingly.

That arm of the cover 21 which is designated II strikes against a stationary stop 35 of the dispenser head 3 (see FIG. 7), its pivoting-out action being limited in this way.

On the other hand, the free end of the arm I strikes against a corresponding inner surface of the dispenser head 3, this likewise forming a stop. The latter stop is designated 36.

As can be gathered from the drawings, the pivot pin 22 of the slit/pivot-pin mounting 23/22 is shifted out of the longitudinal center axis y—y, to be precise in the direction away from the opening cross-section 20.

In order to achieve a highly stable connecting zone between the cover 21 and emptying nozzle 18, the nozzle part, in addition to being stabilized by the tube shape itself, is also stabilized by longitudinal ribs 37 integrally formed on the lateral wall of the vertically running portion b of the emptying nozzle 18.

Functioning is, to summarize briefly, as follows: by virtue of the cover 21 being pivoted in the clockwise direction, that is to say in the direction of the arrow z, the closing portion of the cover 21 is moved out of the region of the opening cross-section 20. This results in the latter standing freely in the emphatically concave jaw 27, this free-standing state rendering the operation of applying the extruded substance clearly visible. With passage over the pivoting path according to angle beta, the opening phase is then followed by an actuating phase. The opening phase takes place with articulated action about the upper end 23' of the slit 23. With the arm I engaging under the window-ledge-like wing 31, this arm I then forms the tilting point for further lowering of the cover 21 via the other arm II as handle H. The pivot pin 22 is displaced on the plunger side in the slit 23. The pivot pin 22 is thus displaced downward, and is accompanied by the emptying nozzle 18. Since the latter is fixed to the squeeze head 13, the squeeze head 13, utilizing the displacement 38 determined by the slit 23, is compressed. This results in compression of the pasty substance 8 due to a reduction in volume in the squeeze head 13. The substance 8, passing via the channel 19 of the emptying nozzle 18 is forced out in extruded portions.

When the handle H, or the cover 21, is released, the emptying nozzle 18, as a result of the restoring force of the squeeze head 13, functioning as a restoring spring of the dispenser mechanism 2, returns into the basic position which can be seen from FIG. 5. This takes place with passage over the rest of the pivoting path according to angle gamma and over the pivoting path according to angle beta. With the so-called self-closing effect being realized, furthermore, the plunger 9 is moved up by one step in the housing 1 via the filling column of pasty substance 8. In the new plane, it locks against the cylindrical inner wall 1' via the abovedescribed clamping module 11.

Any excess substance 8, and possibly any excess substance component applied thereto, is sucked back behind the opening cross-section 19.

In order to increase the restoring force, the dome-like squeeze head 13 has a rib arrangement 13''' at the top on the inside.

Part of the valley-like contour of the jaw 27 is contributed by the lower portion b of the emptying nozzle 18, in the form of a flap-like portion 39 which is connected thereto or extends therefrom. This portion is accommodated, in the basic position, in an outline-adapted through-passage 40 of the dispenser head 3 and, upon actuation of the dispenser, can be lowered together with the emptying nozzle 18.

The handle H, as far as its gripping surfaces are concerned, is very well equipped for actuation. The actuating forces can readily be introduced to good effect via the protrusion 32, which tapers in the manner of a spiked helmet. The dispenser Sp can be actuated in the manner of a classic hand-held lighter.

I claim:

1. Dispenser (Sp) for delivering portions of pasty substances (8), the dispenser comprising: an emptying nozzle (18), a squeeze head (13), and a tubular housing (1) in which a plunger (9) is displaced in a stepwise manner during a process of emptying the dispenser, displacement of the plunger occurring in the direction (arrow x) of the emptying nozzle (18), which is associated with the squeeze head (13), which squeeze head can be pressed in in the direction of the plunger (9) and can be actuated via a handle (H); wherein the squeeze head is associated with a cover (21), which closes the opening cross-section (20) of the emptying nozzle (18), the dispenser further comprises a pivot-pin connection (Dv) being provided between the cover (21) and the emptying nozzle (18), and a slit/pivot pin mounting (23/22) disposed between cover (21) and the housing (1), wherein the slit is fixed to the housing and guides the pin for displacement of the pin along the slit in a direction of the pressing of the squeeze head, a location of the pin in the slit enabling the cover to engage an abutment of the housing during a pivoting of the cover resulting in a deflection of the cover against the squeeze head (13) and the emptying nozzle (18) connected thereto, and wherein, once the cover (21) has been displaced open partially (angle beta), the pivot pin (22) is displaced in the pressing-in direction of the squeeze head (13), and the emptying nozzle (18) is carried along in the process, by way of support against the housing-side abutment (W).

2. Dispenser according to claim 1, wherein the cover (21) and handle (H) form a unit.

3. Dispenser according to claim 1, wherein the cover (21) terminates in a spiked-helmet-like protrusion (32).

4. Dispenser according to claim 1, wherein the abutment (W) is formed by a wing (31) which projects in the direction of the pivot pin (22) and against the underside (30) of which a flank (29) of an arm (I) of the cover (21) strikes.

5. Dispenser according to claim 1, wherein the cover (21) has a lower periphery (33), and the lower periphery (33) of the cover (21) penetrates into a matching recessed channel (34) of the housing (1).

6. Dispenser according to claim 1, wherein the pivoting path (angle beta) of the cover (21) to the point where the opening cross-section (19) of the emptying nozzle is exposed is greater than the rest of the pivoting path (angle gamma) of the cover (21) for the pressing in movement of the squeeze head (13).

7. Dispenser (Sp) for delivering portions of pasty substances (8), the dispenser comprising: an emptying nozzle (18), a squeeze head (13), and a tubular housing (1) in which a plunger (9) is displaced in a stepwise manner during a process of emptying the dispenser, displacement of the plunger occurring in the direction (arrow x) of the emptying nozzle (18), which is associated with the squeeze head (13), which squeeze head can be pressed in in the direction of the plunger (9) and can be actuated via a handle (H); wherein the squeeze head is associated with a cover (21), which closes the opening cross-section (20) of the emptying nozzle (18), the dispenser further comprises a slit and pin assembly serving as a displaceable pivot-pin connection (DV) being provided between the cover (21) and the emptying nozzle (18), wherein the slit is fixed to the housing and guides the pin for displacement of the pin along the slit in a direction of the pressing of the squeeze head, a location of the pin in the slit enabling the cover to engage an abutment of the housing during a pivoting of the cover resulting in a deflection of the cover against the squeeze head (13) and the emptying nozzle (18) connected thereto, and wherein, movement of the cover (21) presses the squeeze head 13 by means of the emptying nozzle (18).

* * * * *